United States Patent [19]

Aguilar

[11] 4,117,666

[45] Oct. 3, 1978

[54] QUICK RESET TIMER

[76] Inventor: Henry Aguilar, 1309 27th Ave., San Francisco, Calif. 94122

[21] Appl. No.: 838,852

[22] Filed: Oct. 3, 1977

[51] Int. Cl.[2] ..... G04F 1/06

[52] U.S. Cl. ..... 58/144; 58/141

[58] Field of Search ..... 58/141, 144

[56] References Cited

U.S. PATENT DOCUMENTS

| | | | |
|---|---|---|---|
| 2,144,857 | 1/1939 | Schultz | 58/144 |
| 2,236,658 | 4/1941 | Wheeler | 58/144 |
| 2,252,035 | 8/1941 | Rockala | 58/144 |

*Primary Examiner*—Robert K. Schaefer

*Assistant Examiner*—Leonard W. Pojunas, Jr.

*Attorney, Agent, or Firm*—Thomas Schneck, Jr.

[57] ABSTRACT

A timer in which a lesser cylinder having funnel-shaped top and bottom portions is disposed within a greater cylinder. Granular material is disposed in the greater cylinder, with a passage or gap provided between the outside diameter of the lesser cylinder and the inside diameter of the greater cylinder so that granular material funneled through the lesser cylinder downwardly to the base of the greater cylinder may be quickly returned at any time by inverting the greater cylinder, thereby allowing another pass of the granular material through the lesser cylinder.

6 Claims, 5 Drawing Figures

QUICK RESET TIMER

BACKGROUND OF THE INVENTION

1. Field of the Invention

The invention relates to resetable timing devices and more particularly, to an improvement in hourglass construction.

2. Prior Art

Previously, quick reset hourglass timing devices have been known and suggested for use in parking meters and the like. One of the problems with parking meter quick reset hourglasses is that they may be viewed only from two sides and generally must be rotated through 360° to be reset. Another drawback is that their construction is usually complicated.

A less complicated hourglass timing device is shown in U.S. Pat. No. 3,103,099 which has a reset feature, but in which the timing fluid cannot be quickly removed from lower end of the device since upon inversion of the device, the fluid must pass through the very small return hole provided.

An object of the present invention is to provide an improved hourglass timing device, of simple construction, which may be seen from any direction radially about the apparatus, is quickly resetable at any time during its cycle and in which a large return path is provided for the fluid when the timer is inverted and blocked when the timer is returned to its normal position.

SUMMARY OF THE INVENTION

The above object is achieved in a quick reset timer which features a cylinder of greater dimensions enclosing a cylinder of lesser dimensions. The lesser cylinder has upper and lower funnel-shaped portions, with the upper portion having an outside diameter matching the inside diameter of the greater cylinder. However, the upper funnel-shaped portion has a chord-wise truncated segment which provides a significant gap between a portion of the upper funnel rim and the inside diameter of the greater cylinder. An amount of fluidic material which is disposed in the greater cylinder can flow through the gap into the upper part of the funnel-shaped lesser cylinder on resetting, then through the lesser cylinder and a funnel spout portion and back to its starting point. A preferred fluid is a sand-graphite mixture.

DESCRIPTION OF THE PREFERRED EMBODIMENT

Figure 1:
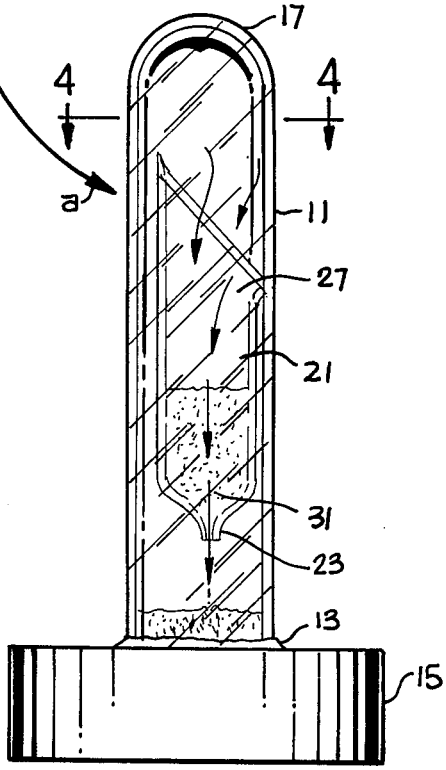
FIG. 1 is a side elevation of the apparatus of the present invention.

With reference to FIG. 1, the quick reset timer of the present invention is shown to comprise a greater elongated transparent cylinder 11. Cylinder 11 has a first end 13 which is closed by cementing to a planar base 15 in a manner such that cylinder 11 projects perpendicularly upward from the planar base 15. A second end 17 of cylinder 11 is a dome-shaped closure for the tube.

Within the greater cylinder 11, a lesser, elongated transparent cylinder 21 is mounted, affixed to the inside wall of greater cylinder 11. Lesser cylinder 21 has a first end 23 resembling the pouring spout of a funnel. End 23 is spaced a first distance from the first end 13 of the greater cylinder 11. Generally, this distance is such that it defines a volume within the first end 13 of the greater cylinder such that an entire amount of fluidic material 31 can be contained in the lower portion of the greater cylinder 11, without contacting the first end 23 of lesser cylinder 21, i.e., exclusive of lesser cylinder 21. A second end of lesser cylinder 21 is opposite the first end at a distance from the second end 17 of greater cylinder 11 such that the distance also defines a volume within greater cylinder 11 which can accommodate all of the fluidic material 31 in the tube system.

The cylinder system of the present invention is an hourglass timing system with time measured by the flow of fluidic material through a narrow aperture or spout in the first end 23 of lesser tube 21. The size of the aperture determines the flow rate of the fluidic material 31. Both the size of the aperture and the nature of the fluidic material determines the measurement of time. It has been found that very fine sand, mixed with very fine graphite provides a preferred fluid, although other materials such as liquids could be used. Graphite is thought to limit static charge buildup and prevent sand from sticking to the walls of the apparatus in addition to providing lubricating qualities. In the present invention, the fluidic material flows in the direction indicated by the arrows in the tube system through the lesser cylinder 21 into the first end 13 of greater cylinder 11.

Each of the transparent cylinders is made of a material such as glass or transparent plastic, with lesser cylinder 21 having portions of its second end 27 flared outwardly until it reaches the inside diameter of greater cylinder 21. Lesser cylinder 21 has an outside diameter less than the inside diameter of greater cylinder 11. One of the features of the second end 27 of the lesser cylinder is that although the cylinder has an upper portion flared outwardly, it has a chord-wise truncation which when inverted permits fluidic material to flow from first end 13 of the greater cylinder past the lesser cylinder into the dome-shaped second end of greater cylinder 11. Greater cylinder 11 may have other shapes, such as a dumb bell shape, and need not be a cylinder of circular cross section, but may have any closed curve cross section.

Figure 2:
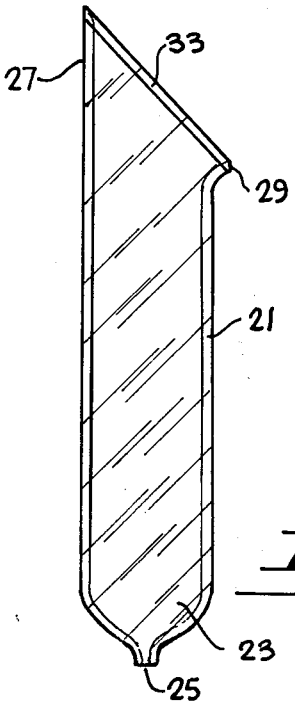
FIG. 2 is a side view of a lesser cylinder of the apparatus of the present invention, shown in FIG. 1 to be within a greater cylinder.

The shape of lesser cylinder 21 may be seen more clearly with reference to FIG. 2. In FIG. 2, lesser cylinder 21 is seen to have an aperture or spout 25 at its first end 23. If the overall length of lesser tube 21 approximates 5 inches, the dimension of aperture 25 would typically be less than 1/32 of an inch, but this depends on the rate at which fluidic material is to flow out of the tube 21 for a desired measure of time, given a certain amount of fluidic material. The cross sectional shape of cylinder 21 should be similar to the cross sectional shape of cylinder 11.

Figure 3:
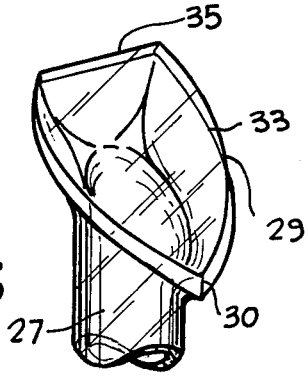
FIG. 3 is a partial cutaway perspective view of the upper portion of the lesser cylinder shown in FIG. 2.

With reference to FIG. 3, it may be seen that the outwardly flared portion 29 of the lesser cylinder forms a funnel-shaped opening which is slanted at approximately 45° to the axis of the lesser cylinder. However, the uppermost portion 35 of the rim, a chord of truncation, is not flared but rests against an imaginary plane, seen as a chord 35 traversing the greater cylinder in FIG. 4, tangent to the outer wall of the lesser cylinder. The flared portion of the sloping rim 33 rests against the inner wall of the greater cylinder to which it is bonded by an adhesive. The lowest portion 30 of the flared portion 29 forms a fairly sharp "V" so that when the timer is inverted, the granular material will not find a ledge on which to rest but will part at the inverted "V" and slide down one side or the other of the under side of the funnel through the gap defined by the chord between the lesser and greater cylinders. The size of the gap should be sufficient to allow all fluid material to pass therethrough in a few seconds, e.g. approximately two seconds.

The adhesive which bonds rim 33 to the inside wall of greater tube 11 is any adhesive which makes good contact between tubes and which will not detrimentally interact with the fluidic material.

Figure 4:
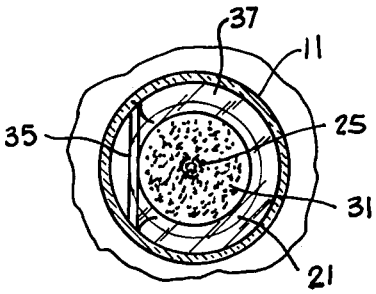
FIG. 4 is a section taken along lines 4—4 in FIG. 1.

FIG. 4 is a sectional view looking downwardly in the direction of the arrows 4—4 in FIG. 1. Lesser tube 21 may be seen to contain the fluidic material 31 which is being funneled downwardly to the aperture indicated by the dashed line 25. Chord 35 is seen truncating the upper rim of the lesser tube which mates with the inside wall of greater tube 11. The central portion of lesser tube 21 may be coaxial with greater tube 11, but is preferably offset to allow the greatest passageway or gap between cylinder at the chord 35 and the inside wall of the greater cylinder.

The space 37 between the lesser and greater tube is a flow zone for fluidic material. The under side of the rim acts as a guide for fluidic material to flow over chord 35 into the dome-shaped second end of the greater tube. This is more clearly illustrated with reference to FIG. 5.

Figure 5:
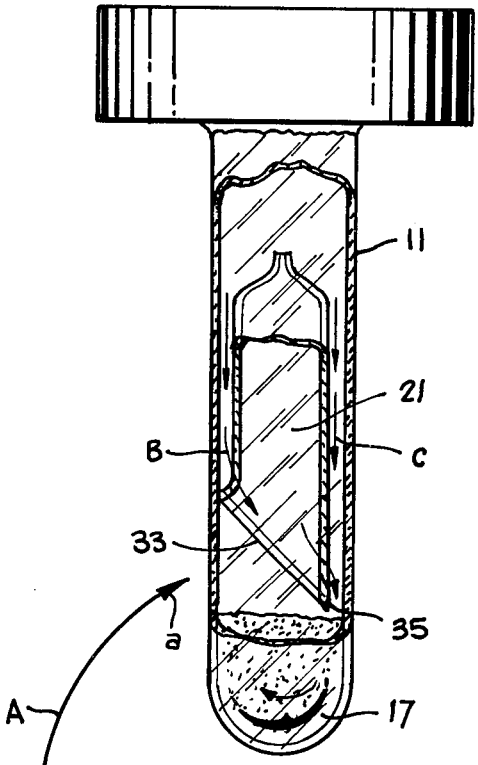
FIG. 5 is another side elevation of the apparatus of FIG. 1 illustrating the quick reset feature of the apparatus of the present invention.

FIG. 5 illustrates the apparatus of FIG. 1 inverted as indicated by the arrow A. In FIG. 5, fluidic material flows in the direction indicated by the arrows B, C. In the case of fluidic material following the trajectory indicated by arrow B, the fluidic material flows over the back side of rim 33 and since the rim is bonded to the inside of the greater cylinder 11, it cannot enter the second end 17 of the greater cylinder until it flows over the chord-wise truncated portion of rim 33. Thus, all of the fluidic material flows past chord 35 when the timing system of the present invention is reset. To begin timing again, the apparatus is rotated in a vertical plane in the same direction with the "V" of the funnel forming an arrowhead pointing in the direction of rotation, corresponding to the rotation indicated by the arrowheads *a—a* in FIGS. 1 and 5, i.e., 180° in the reverse direction, simultaneously pouring the fluidic material into the upper funnel portion of the lesser cylinder. One of the advantages of this reset mechanism is that the apparatus rotates in the vertical plane only through plus and minus 180°, as indicated by the arrowheads *a—a*. It will be observed that none of the fluidic material can drop back towards the base of greater cylinder 11 by this resetting plan without flowing through the lesser cylinder 21.

In the present invention, the term "cylinder" should be broadly interpreted to include containers generated by surfaces of revolution, such as dumb bell shapes, and the like, but also containers which have polygonal cross sections.

What is claimed is:

1. A quick reset timer comprising, a greater elongated transparent cylinder of a first inside diameter and a first length, having first and second closed ends, a lesser, elongated transparent cylinder of a second outside diameter and a second length, both lesser than said first diameter and first length, and having first and second ends, said first end resembling the pouring spout of a funnel and spaced a first distance from the first end of said greater cylinder, said second end having a chord-wise truncated, sloped, funnel-shaped rim defining a gap between lesser and greater cylinders, said rim being bonded to the inner wall of the greater cylinder at a second distance from the second end of said greater cylinder, and an amount of fluidic material disposed in said greater cylinder capable of flowing through the first end of said lesser cylinder to collect in the first end of the first cylinder and when inverted capable of flowing through said gap to collect in the second end of the first cylinder, said first and second distances each of a magnitude for defining volumetric regions in said greater cylinder for containing all of said amount of fluidic material exclusive of said lesser cylinder.

2. The apparatus of claim 1 wherein said fluidic material is a sand-graphite mixture.

3. The apparatus of claim 1 wherein said quick reset timer further comprises a flat base wherein the first end of said greater cylinder is mounted so that said greater cylinder projects upwardly with respect to said base.

4. The apparatus of claim 1 wherein said rim has a V-shape.

5. The apparatus of claim 4 wherein said rim is truncated by said chord tangent to said lesser cylinder.

6. The apparatus of claim 1 wherein said fluidic material is a liquid.

* * * * *